US007451998B2

(12) United States Patent
Wagner, Jr.

(10) Patent No.: US 7,451,998 B2
(45) Date of Patent: Nov. 18, 2008

(54) METHOD AND APPARATUS FOR INDICATING SLIDING BOARD FEATURES

(75) Inventor: Richard William Wagner, Jr., Waterbury, VT (US)

(73) Assignee: The Burton Corporation, Burlington, VT (US)

( * ) Notice: Subject to any disclaimer, the term of this patent is extended or adjusted under 35 U.S.C. 154(b) by 91 days.

(21) Appl. No.: 11/582,214

(22) Filed: Oct. 17, 2006

(65) Prior Publication Data

US 2008/0088100 A1 Apr. 17, 2008

(51) Int. Cl.
*A63C 9/00* (2006.01)
*A62B 3/00* (2006.01)

(52) U.S. Cl. ..... 280/633; 280/14.21; 280/14.22; 280/809

(58) Field of Classification Search ..... 280/14.24, 280/14.21, 14.22, 611, 633, 607, 610, 809; 101/32, 5; 411/378, 923, 180, 116
See application file for complete search history.

(56) References Cited

U.S. PATENT DOCUMENTS 3,504,723 A * 4/1970 Cushman et al. ..... 411/116
3,593,356 A 7/1971 Schmalfeldt
4,871,337 A * 10/1989 Harris ..... 280/14.24
5,221,105 A * 6/1993 Mayr et al. ..... 280/633
5,244,326 A * 9/1993 Henriksen ..... 411/180
5,609,351 A * 3/1997 Vermillion ..... 280/611
5,673,927 A * 10/1997 Vermillion ..... 280/611
5,839,747 A * 11/1998 Gervasoni ..... 280/611
6,042,126 A * 3/2000 Muller et al. ..... 280/14.22
6,073,552 A * 6/2000 Cruse et al. ..... 101/32
6,089,581 A * 7/2000 Partridge ..... 280/14.24
6,095,739 A * 8/2000 Albertson et al. ..... 411/439

FOREIGN PATENT DOCUMENTS

EP 0852157 A2 7/1998
JP 3087526 4/1991
JP 6-225957 8/1994
JP 8-257201 10/1996
JP 3043639 11/1997
WO WO03051472 A1 6/2003

OTHER PUBLICATIONS

Japanese Search Report, Application No. 007946/2007 dated Oct. 16, 2007.
European Search Report, Application No. 07020143.9 dated Feb. 12, 2008.

* cited by examiner

*Primary Examiner*—Hau V Phan
(74) *Attorney, Agent, or Firm*—Wolf Greenfield & Sacks, P.C.

(57) ABSTRACT

Method and apparatus for indicating gliding board features using an indicator adjacent an attachment point on the board used to secure an associated component, such as a binding, to the board. The indicator may indicate a board type (beginner, expert, etc.), a component used in the board (e.g., a core material used), a supplier of the board, a rider stance location, or other feature. Indicators may be located adjacent an opening of an attachment point, such as a hole in a threaded insert or slot of a channel embedded in a board body.

23 Claims, 3 Drawing Sheets

METHOD AND APPARATUS FOR INDICATING SLIDING BOARD FEATURES

BACKGROUND OF INVENTION

1. Field of Invention

This invention relates to indicating features relating to a sliding board, such as a snowboard, ski, knee board, kite board, wind surfing board, surfboard, wakeboard or other sliding device.

2. Related Art

Sliding boards, such as snowboards, are commonly made to have various features that are not necessarily apparent when observing the board from its exterior. For example, some snowboards are designed for use by beginner riders, whereas others are made for the expert. Other boards may be made for performing tricks, such as in a half pipe or trick park, whereas other boards may be made for racing at speed. Other boards may include internal components, such as a particular type of core material, whereas another board may have a different core.

In many cases, it may be difficult or impossible to determine a specific feature of a board by simple reference to the board itself. Often, resort to a specifications sheet or other information source (e.g., salesperson, rental agent, etc.) must be made to determine details of a board.

SUMMARY OF INVENTION

Aspects of the invention relate to providing one or more indications of a feature relating to a sliding board, such as a snowboard, by way of a marking or other element associated with the board. The feature(s) indicated may include a board type (e.g., beginner, intermediate, expert, rental, alpine, freestyle, freeride, child, women's, etc.), a board component used in the board (e.g., a core material or type, a base material or type, a reinforcement material used, etc.), a stance location (e.g., a first color may indicate a first stance width, a second color a second stance width, etc., or a first color may indicate a stance location for normal riding, whereas a second color may indicate a stance location for powder riding, etc.), a supplier or manufacturer of the board, and so on.

In one aspect of the invention, a board feature may be indicated by an indicator that is located at any suitable place on the board, e.g., adjacent a connection point on the board. For example, in one embodiment, threaded insert holes in a snowboard to receive mounting screws for a binding may be surrounded by a ring-shaped indicator. The indicator may be colored, include printed text or other information, have a specified shape or otherwise carry information regarding a feature to be indicated. In one embodiment, the indicator may include an annular ring that is set within a counterbore formed in the top sheet of the board. The ring may be positioned so that the hole in the ring is aligned with the threaded hole of a corresponding insert. Thus, the ring may allow a user to engage the threaded insert with a fastener like normal by inserting the fastener through the opening in the ring and engaging the threaded insert.

In another illustrative embodiment, one or both sides of a channel formed in a board for mounting a binding may be flanked with an indicator. For example, the channel may have a strip of colored or otherwise marked material adjacent the channel slot that extends along the slot. As in the example above, the indicator may have one or more colors, text markings, etc. to convey desired information regarding the board. Also, the indicator need not include only a single marking type, but may include one or more markings. For example, a first color on the indicator may indicate a first stance location, while a second color on the indicator may indicate a second stance location.

In another illustrative embodiment, a gliding board includes a board body constructed and arranged to support a rider in sliding on a surface. The board body may have a top, a bottom, opposite side edges, a nose and a tail, and an attachment point may be secured to the board body. The attachment point may have an opening constructed and arranged to engage with a fastener to mount an associated component to the board, such as a foot binding. An indicator may be secured adjacent the opening of the attachment point and represent information regarding a feature of the gliding board, such as a board type, a stance location, a board component used in the board, or a supplier of the board.

In another embodiment, a gliding board includes a board body constructed and arranged to support a rider in sliding on a surface. The board body may have a top, a bottom, opposite side edges, a nose and a tail, and an attachment point may be secured to the board body. The attachment point may have an opening constructed and arranged to engage with a fastener to mount an associated component to the board, such as a foot binding. An indicator may be secured adjacent the opening of the attachment point and include a colored portion to represent information regarding a feature of the gliding board.

In another embodiment, a snowboard includes a gliding board includes a board body constructed and arranged to support a rider in sliding on a surface. The board body may have a top, a bottom, opposite side edges, a nose and a tail, and a threaded insert may be fixed within to the board body. The threaded insert may have an opening constructed and arranged to engage with a fastener to mount an associated component to the board, such as a foot binding. An indicator may be secured adjacent the opening of the attachment point to be visible at the board top and represent information regarding a feature of the snowboard.

These and other aspects of the invention will be appreciated from the following detailed description and claims.

BRIEF DESCRIPTION OF THE DRAWINGS

Aspects of the invention are described herein with reference to the following drawings in which like numerals reference like elements, and wherein.

DETAILED DESCRIPTION

Aspects of the invention are described herein with reference to illustrative embodiments, but it should be understood that the invention is not limited to the illustrative embodiments. For example, although aspects of the invention are described with reference a snowboard and associated devices, the invention is not so limited. Instead, aspects of the invention may be used with other gliding boards, such as a ski, knee board, kite board, windsurfing board, surfboard, wakeboard or other sliding device. Also, although embodiments are described below with reference to an indicator being located adjacent to an attachment point, in other aspects of the invention, the indicator(s) may be positioned in any suitable place on a board. For example, a colored sidewall portion of a snowboard may indicate the board type, a component used in the board, etc. Colored markings or other indicators on the board edges or in other locations may alternately be used to provide a desired feature indication. Thus, aspects of the invention are not necessarily limited to use of an indicator adjacent an attachment point.

Figure 1:
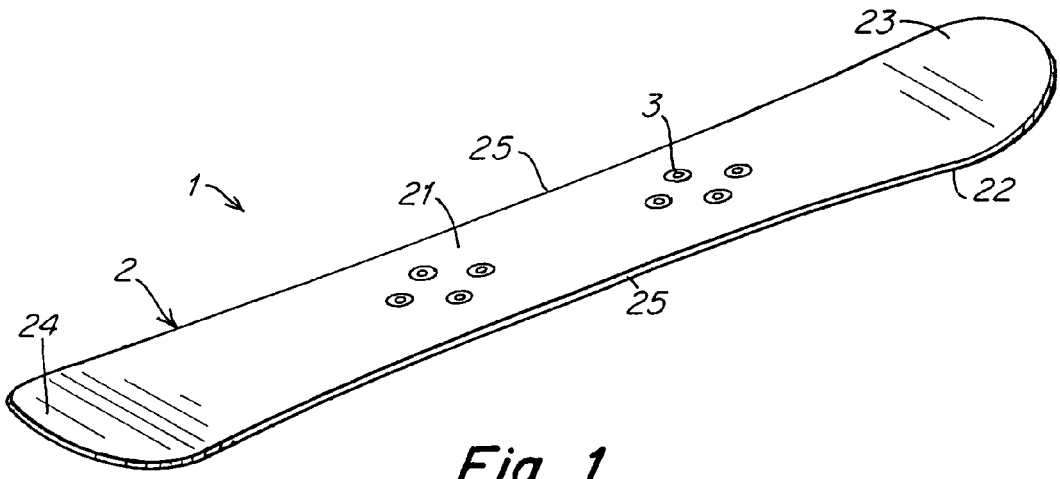
FIG. 1 shows a perspective view of a snowboard in accordance with aspects of the invention.

FIG. 1 shows a snowboard 1 that incorporates various aspects of the invention. In this illustrative embodiment, the snowboard 1 includes a board body 2 with a top 21, a bottom 22, a nose 23, a tail 24 and opposite side edges 25. The board body 2 may be constructed in any suitable way, e.g., may include any suitable core material, top and bottom reinforcement layers (e.g., fiberglass/resin composites, etc.), any suitable base or bottom material, metal edges extending along the side edges 25, etc., as is known in the art. The board body 2 may have a sidewall construction, cap construction, a mixed sidewall/cap construction, etc. In short, the board body 2 may be formed in any suitable way.

The snowboard 1 may have one or more attachment points 3 that are secured to the board body 2. In this illustrative embodiment, the attachment points 3 may be threaded inserts that are embedded within the board body 2 and that have an opening 31 that is accessible from the top 21 of the board body 2, e.g., to engage a threaded fastener to the threaded insert. The threaded insert may be used to secure a foot binding to the board body 2, or other associated component.

Figure 2:
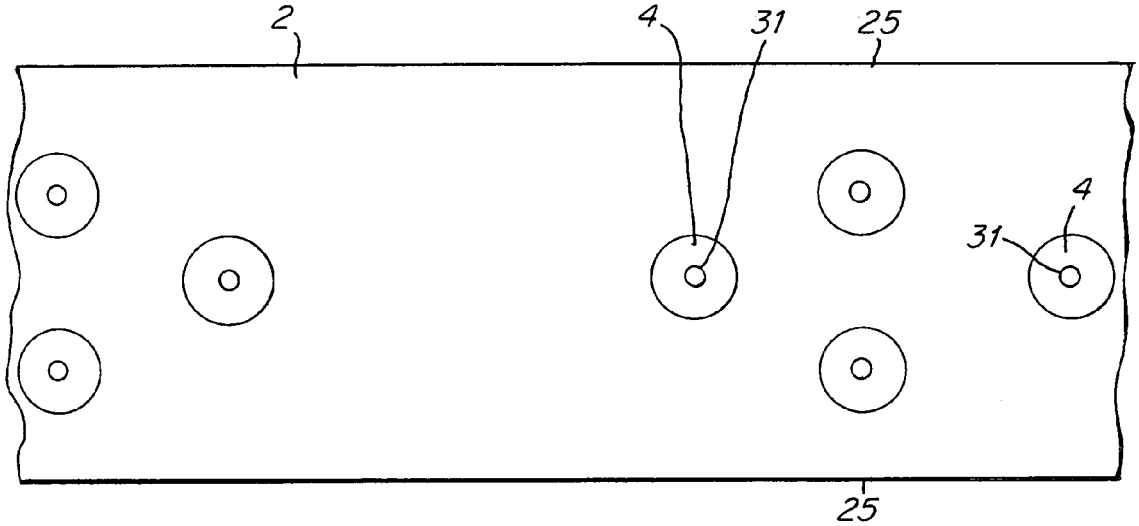
FIG. 2 shows a close up view of several attachment points and indicators in the FIG. 1 embodiment.

In accordance with one aspect of the invention and as shown in FIG. 2 (a close up view of the attachment points 3 of the FIG. 1 snowboard), an indicator 4 is positioned adjacent the opening 31 for at least one threaded insert and is visible at the top 21 of the board body 2. In this embodiment, the indicators 4 have an annular appearance and are located adjacent each of the threaded inserts shown, but may be arranged in other ways. The indicators 4 may indicate a feature of the snowboard 1, such as a board type, e.g., beginner, intermediate, expert, rental, alpine, freestyle, freeride, child, women's, etc. For example, one or more indicators that are colored "blue" may indicate that a snowboard is a rental snowboard. "Red" indicators may represent that the snowboard is suitable for use by children, and so on. Thus, both "red" and "blue" indicators on a single board could indicate a "children's rental" board. The indicators 4 may include a text indication, e.g., printed "rental" text on the indicator 4, to aid in determining the board feature represented by the indicator 4. Thus, the indicator 4 may be arranged in any suitable way to indicate features of the board. Coloring of the indicators 4 may be provided by paint, anodizing, electroplating, and/or the color of material in the indicator itself. Text (including letters, numbers, symbols, etc.) may likewise be printed, molded, etched, etc.

The indicator may alternately indicate a board component used in the board, such as, a material and/or construction technique used for the core (wood, foam, etc.), a base material or type (a base including a low melting point metal or alloy, etc.), a reinforcement material used (fiberglass, carbon fiber, etc.) and so on. This may aid in determining features of the board that are not otherwise readily apparent from the exterior of the board.

Figure 3:
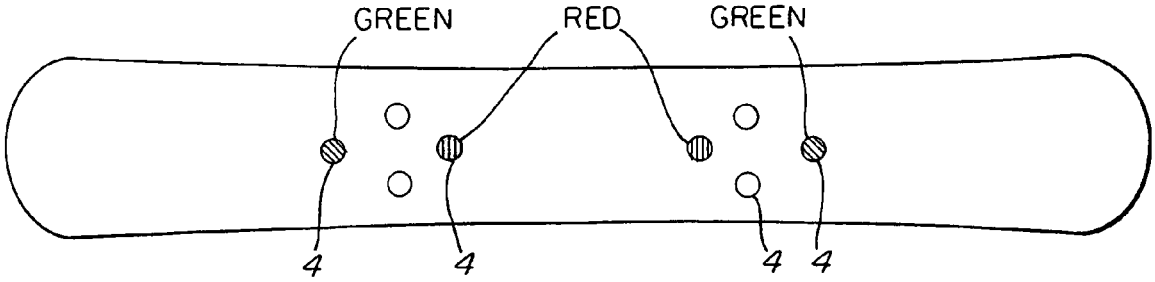
FIG. 3 shows a schematic view of indicators used to provide information regarding stance location on a board.

In another embodiment, one or more indicators 4 may represent a stance location for a rider. For example, when riding in powder, a rider may want to be located nearer the tail of the board than the nose as compared to when using the board in normal, groomed snow conditions. In such a case, indicators 4 may represent stance locations for powder riding and for "normal" riding so that the rider can easily identify inserts for mounting bindings depending on the riding conditions. In another illustrative embodiment, the indicators 4 may represent different stance widths on the board body 2. On a snowboard 1, the rider typically mounts one foot binding toward the front, and another binding toward the rear. Indicators 4 may be colored or otherwise marked so that certain color combinations indicate a particular stance width. For example, as shown in FIG. 3, when mounting front and rear bindings using "red" indicators 4, a stance width of a first distance may result. When mounting the bindings using "green" indicators 4, a stance width of a second distance greater than the first may result. Mounting the bindings using a combination of "red" and "green" attachment points may result in a stance width that is between the first and second distances. With uniformity between boards, a rider may need only remember the color or color combinations for attachment points to use when mounting a binding to get the right stance width.

Figure 4:
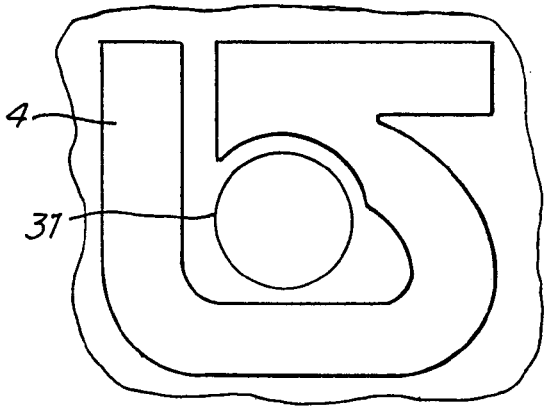
FIG. 4 shows a view of one illustrative embodiment of an indicator.

In another embodiment, the indicators 4 may represent a supplier or manufacturer of the board. Again, the indicators 4 may include one or more colors, text or other features to provide the desired information. In another illustrative embodiment, the indicators 4 may have an outer shape that is not necessarily circular. For example, the indicators 4 may have a shape that matches or generally conforms with a logo or other representation of the board manufacturer. FIG. 4 shows one illustrative embodiment in which the indicators 4 may have the outer shape of a stylized "b", representing Burton Snowboards, that is adjacent the opening 31 of a threaded insert in a board. Of course, it will be understood that other shapes for the indicators 4 may be used.

Figure 5:
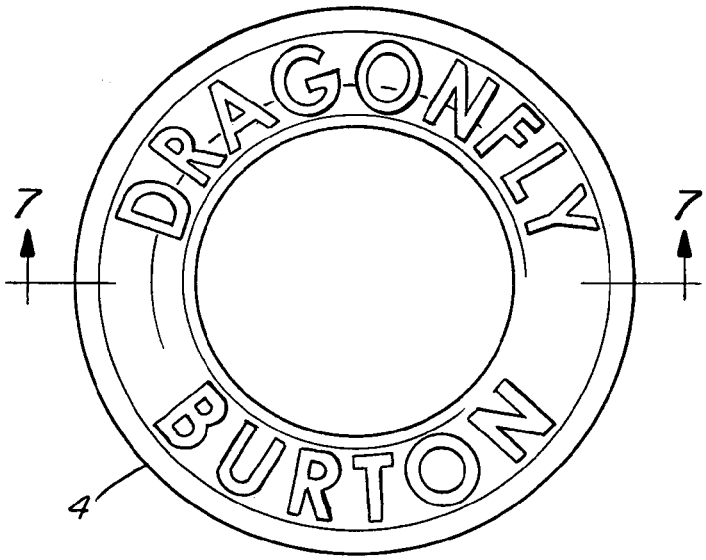
FIG. 5 shows a top view of another illustrative embodiment of an indicator.
Figure 6:
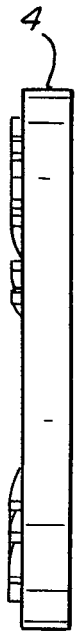
FIG. 6 shows a side view of the FIG. 5 indicator.
Figure 7:
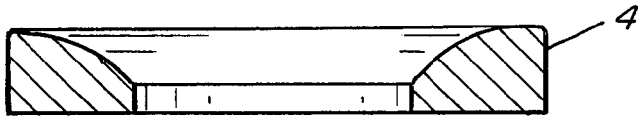
FIG. 7 shows a cross-sectional view of the FIG. 5 indicator.

FIGS. 5-7 show top, side and cross-sectional views, respectively, of an indicator 4 in an illustrative embodiment. The indicator 4 in this example has an overall annular shape with an outer diameter of about 11 mm and an inner diameter of about 6 mm. The thickness of the element 4 in this embodiment is not uniform, i.e., as can be seen in FIG. 7, the element 4 is thicker near the outer diameter and tapers to a reduced thickness near the inner diameter. This thickness near the outer diameter is about 1 mm and the thickness near the inner diameter is about 0.3 mm or less. The indicator 4 in this embodiment also includes text to represent the manufacturer of the board ("Burton") and a component used in the board (the core type known as "Dragonfly"). As can be seen in FIG. 6 (but is not shown for clarity purposes in FIG. 7), the text in this embodiment is raised above the body of the indicator 4.

Figure 8:
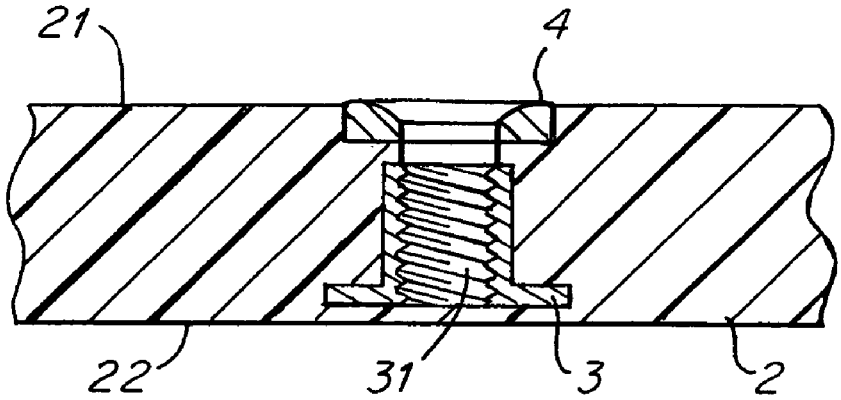
FIG. 8 shows a cross-sectional view of a snowboard including the FIG. 5 indicator.

FIG. 8 shows an embodiment in which the indicator 4 of FIGS. 5-7 is used with a threaded insert in a snowboard. As can be seen in this cross-sectional view, the indicator 4 is set within a counterbore that is formed in the top 21 of the board body 2 above the threaded insert. The counterbore is sized to closely fit the indicator 4 at its outer diameter, and the depth of the counterbore is arranged in this embodiment so that the upper portion of the indicator 4 extends above the top of the board body 2, e.g., about 0.1 mm. Of course, in other embodiments, the indicator 4 may be positioned below the top 21 of the board body 2, or may extend further above the top of the board. The indicator 4 may be secured in the counterbore by an adhesive, e.g., a pressure sensitive adhesive applied to the lower side of the indicator 4 that sticks to the board body 2 when the element 4 is engaged with the counterbore. The indicator 4 may be engaged with the board body 2 in other ways, such as by other adhesives, screw or other fasteners, an interference fit, engagement with the threaded insert, etc. In one embodiment, the indicator 4 may be made integrally with the threaded insert, if desired.

Figure 9:
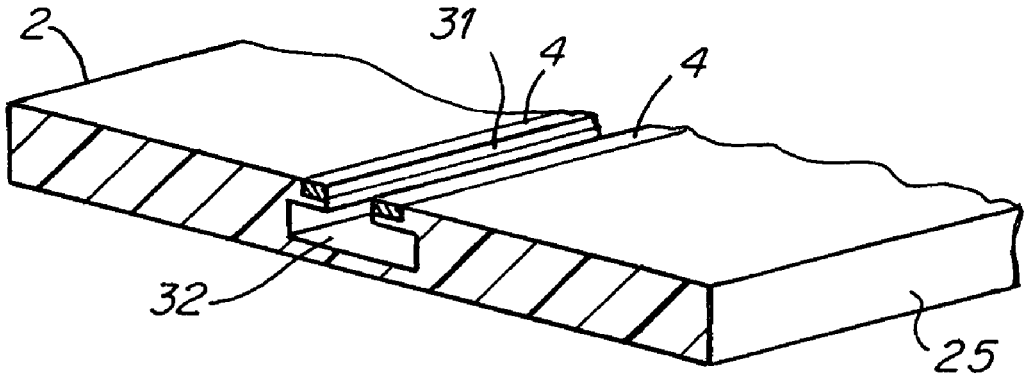
FIG. 9 shows a schematic view of a board having a slot-type binding mounting arrangement with an indicator adjacent the slot.

FIG. 9 shows another illustrative embodiment of an indicator 4 used with an attachment point 3 that includes a channel 32 fixed within the board body 2. Such channels are known in the art for securing foot bindings to a board, and typically include a metal member that is embedded within the board and that has a slot or other opening 31 exposed on the top 21 of the board body 2. As is known, a fastener, such as a T-nut, may be engaged in the channel 32 such that a fastener or other member may engage with the T-nut at the slot 31 to mount a binding. In this illustrative embodiment, the indicator 4 includes a colored element that extends along at least one side of the slot 31. The indicator 4 in this embodiment includes a strip of material that is embedded in a groove formed in the top 21 of the board body 2 adjacent the slot 31. A portion of the indicator 4 may extend downward into the slot 31 and provide a wear surface on the walls of the slot 31 for the T-nut or other binding fastener, if desired. The indicator 4 may have a single, solid color along its length, or may have two or more differently colored sections along its length, e.g., when providing stance location information. As in the other embodiments described, the indicator 4 may include text or graphic information, have a desired shape, etc. to convey desired information.

In the embodiments above, the indicators 4 include a solid metal, plastic or other material body, but the indicators may be formed in other ways. For example, the indicators 4 may be formed by paint or other marking that is provided on the top 21 of the board and/or the attachment point 3. In an embodiment like that in FIG. 2, the indicator 4 may be formed by applying a paint or other marking material to the top 21 of the board and/or the top of the threaded insert. Indicators 4 like that in FIG. 2 may also operate as a type of lock washer in some embodiments, helping to engage the fastener with the threaded insert or other attachment point 3. The indicator 4 may also help locate a binding properly on the top 21 of a board body 2. For example, the indicator 4 of FIG. 2 may extend above the top 21 of the board body 2 and engage with a corresponding recess in a binding base or hold down disk, thereby helping to reduce linear movement of the binding or hold down disk in the plane of the top 21. In this illustrative embodiment, the indicator 4 may have a cylindrical shape that protrudes above the top 21 of the board, or any other suitable shape, such as conical, oval, triangular, etc. Correspondingly, the binding base or hold down disk may have a complementary recess in its bottom, such as a cylindrical bore, a conical recess, etc. Indicators 4 may be incorporated into graphics or other visual information on the board body 2, e.g., may form an eye of an animal.

In another embodiment, the indicators 4 may provide a damage or overstress indication for the board, such as when a board has been impacted or flexed in a way beyond design parameters. In case of such potential damage, the indicators 4 may change in some way, such as be released from the board, change color, or otherwise alter in appearance. For example, the indicators 4 may be made of a stress sensitive material such that stress on the indicators 4 causes a color change in the elements.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A gliding board comprising:

a board body constructed and arranged to support a rider in sliding on a surface, the board body having a top, a bottom, opposite side edges, a nose and a tail;

an attachment point secured to the board body, the attachment point having an opening constructed and arranged to engage with a fastener to mount an associated component to the board; and an indicator permanently fixed to the board body adjacent the opening of the attachment point, the indicator having a visual appearance that is different from the attachment point and representing information regarding a feature of the gliding board including a board type, a board component used in the board other than a code for the attachment point or a fastener used to mount an associated component to the board, or a supplier of the board.

2. The gliding board of claim 1, wherein the attachment point includes a threaded insert that is fixed within the board body and that has an opening accessible from the top of the board body to engage a fastener with the threaded insert.

3. The gliding board of claim 2, wherein the indicator includes an annular marking around the opening of the threaded insert.

4. The gliding board of claim 3, wherein the annular marking includes a ring that is fixed within a counterbore formed in the board body around the threaded insert opening.

5. The gliding board of claim 4, wherein the ring extends above the top of the board body.

6. The gliding board of claim 4, wherein the ring extends above the top of the board body by a distance of about 0.2 mm.

7. The gliding board of claim 6, wherein the ring is formed of a metal or plastic material.

8. The gliding board of claim 4, wherein the ring has a thickness that is greater near an outer diameter of the ring as compared to a thickness near an inner diameter of the ring.

9. The gliding board of claim 8, wherein the outer diameter is about 11 mm and the inner diameter is about 6 mm.

10. The gliding board of claim 3, wherein the indicator includes a colored portion to provide the indication of the gliding board feature.

11. The gliding board of claim 1, wherein the attachment point includes a channel member that is fixed to the board and that has a slot that is accessible from the top of the board to engage a binding to the channel member.

12. The gliding board of claim 11, wherein the indicator includes a marking that extends along an edge of the slot at the top of the board body.

13. The gliding board of claim 12, wherein the indicator includes a strip of material that extends along the slot and partially extends into the slot.

14. The gliding board of claim 12, wherein the indicator includes a colored portion to provide the indication of the gliding board feature.

15. The gliding board of claim 1, wherein the indicator is immediately adjacent the attachment point such that no intervening element is located between the indicator and the attachment point.

16. The gliding board of claim 1, wherein the associated component is a foot binding.

17. The gliding board of claim 1, wherein the board body defines a snowboard.

18. A gliding board comprising:

a board body constructed and arranged to support a rider in sliding on a surface, the board body having a top, a bottom, opposite side edges, a nose and a tail;

an attachment point secured to the board body, the attachment point having an opening constructed and arranged to engage with a fastener to mount an associated component to the board; and an indicator permanently fixed to the board body adjacent the opening of the attachment point, the indicator including a colored portion with a visual appearance that id different from the attachment point to represent information regarding a feature of the gliding board, wherein the information regarding the gliding board feature is unrelated to a code for the attachment point or fastener, or other information regarding mounting an associated component to the board.

19. The gliding board of claim 18, wherein the feature of the gliding board represented by the colored portion is a board type, a board component used in the board, or a supplier of the board.

20. The gliding board of claim 18, wherein the associated component is a foot binding.

21. A snowboard comprising:

a board body constructed and arranged to support a rider in sliding on a surface, the board body having a top, a bottom, opposite side edges, a nose and a tail;

a threaded insert fixed to the board body, the threaded insert including an opening accessible from the top of the board body so as to allow engagement of a fastener with the threaded insert; and an indicator permanently fixed to the board body adjacent the opening of the threaded insert, the indicator having a visual appearance that is different from the threaded insert and being visible at the board top and representing information regarding a feature of the snowboard, wherein the information regarding the snowboard feature is unrelated to a code for the threaded insert or fastener used to mount an associated component to the board.

22. The snowboard of claim 21, wherein the indicator comprises a ring shaped element disposed on the top of the board body around the opening of the threaded insert.

23. A gliding board comprising:

a board body constructed and arranged to support a rider in sliding on a surface, the board body having a top, a bottom, opposite side edges, a nose and a tail;

a plurality of attachment points secured to the board body, each attachment point having an opening constructed and arranged to engage with a fastener to mount a binding to the board; and a plurality of sets of indicators, each indicator being permanently fixed to the board body adjacent to the opening of a corresponding attachment point, the indicators in each set having a same visual appearance, including a color, that is different from an adjacent attachment point, the same visual appearance of indicators in a set representing a stance width range for the mounting of a pair of bindings to the board such that with the pair of bindings mounted to the board using fasteners engaged with an attachment point located adjacent indicators in a set, a stance width between the bindings falls within a known distance range, and wherein each set of indicators represents a different stance width range.

* * * * *